United States Patent [19]

Mancuso

[11] Patent Number: 4,859,126

[45] Date of Patent: Aug. 22, 1989

[54] APPARATUS AND METHOD FOR REMOVING DROSS RIDGES FROM A METAL WORKPIECE

[75] Inventor: Matthew A. Mancuso, New Kensington, Pa.

[73] Assignee: Keibler-Thompson Corp., Kensington, Pa.

[21] Appl. No.: 13,134

[22] Filed: Feb. 10, 1987

Related U.S. Application Data

[63] Continuation-in-part of Ser. No. 847,421, Apr. 2, 1986, abandoned, which is a continuation-in-part of Ser. No. 834,834, Feb. 21, 1986, abandoned.

[51] Int. Cl.[4] ..... B23D 1/22; B23K 7/02

[52] U.S. Cl. ..... 409/293; 266/48; 409/300; 409/348

[58] Field of Search ..... 409/293, 297, 300, 319, 409/321, 348, 157; 29/81 J; 266/48, 49

[56] References Cited

U.S. PATENT DOCUMENTS

| | | | |
|---|---|---|---|
| 1,535,875 | 4/1925 | Sutton | 409/293 |
| 2,120,316 | 6/1938 | Stone | 29/335 |
| 2,301,923 | 11/1942 | Babcock | 148/3 |
| 4,362,448 | 12/1982 | Hasebe et al. | 409/300 |
| 4,390,167 | 6/1983 | Ito et al. | 266/48 |
| 4,498,821 | 2/1985 | Cazaux | 409/300 |
| 4,522,540 | 6/1985 | Hasebe et al. | 409/293 |
| 4,610,586 | 9/1986 | Langeder | 409/300 |

FOREIGN PATENT DOCUMENTS

| | | |
|---|---|---|
| 119847 | 5/1901 | Fed. Rep. of Germany . |
| 893605 | 10/1953 | Fed. Rep. of Germany . |
| 261871 | 8/1970 | U.S.S.R. . |
| 882715 | 11/1981 | U.S.S.R. . |
| 971589 | 11/1982 | U.S.S.R. . |

OTHER PUBLICATIONS

"Patent Abstracts of Japan", vol. 7, No. 197 (M-239) [1342], Aug. 27, 1983.

*Primary Examiner*—Z. R. Bilinsky

*Attorney, Agent, or Firm*—Bell, Seltzer, Park & Gibson

[57] ABSTRACT

An apparatus and method are disclosed for removing the dross ridges which are formed on the lower surface of a metal workpiece during torch cutting of the workpiece. The apparatus includes a cutting blade having a generally flat outer surface and a cutting edge along each of its two opposite sides. The blade is positioned to extend across and below the workpiece path of travel, and the blade is rotatable between a neutral position wherein the blade is below the pass line of the workpiece, and opposite tilted positions in which one or the other of the cutting edges engages the lower dross carrying surface of the workpiece, and so that each cutting edge is adapted to engage and remove a dross ridge on the workpiece.

19 Claims, 4 Drawing Sheets

APPARATUS AND METHOD FOR REMOVING DROSS RIDGES FROM A METAL WORKPIECE

CROSS REFERENCE TO RELATED APPLICATIONS

This is a continuation-in-part of application Ser. No. 847,421 filed Apr. 2, 1986 now abandoned, which in turn is a continuation-in-part of application Ser. No. 834,834 filed Feb. 21, 1986 also abandoned.

BACKGROUND OF THE INVENTION

The present invention relates to an apparatus and method for removing dross ridges from metal workpieces, such as slabs, blooms, billets, or the like.

In the production of steel by, for example, the continuous casting process, the continuous cast length emerging from the caster is cut into desired lengths to form separate metal workpieces, which are commonly referred to as slabs, blooms, or billets. The separate workpieces are then subjected to subsequent processing, as by rolling, to form a finished steel product.

The cutting operation as described above is conventionally performed by means of a flame or torch, wherein a jet of high purity oxygen is directed against the workpiece while it is heated to the oxygen ignition temperature. The resulting exothermic chemical reaction between the iron and oxygen produces slag or waste, which consists of iron oxide, metallic iron and other alloy elements. This slag or waste is in the molten state, and it is displaced during the cutting operation and a portion thereof forms a ridge of the material along the lower edge of the cut end. Upon cooling, the material solidifies and adheres to the workpiece surface along the bottom surface adjacent the cut end, and forms what is commonly called a "dross ridge".

The formation of the dross ridges on the workpiece presents problems in the further processing thereof. For example, a dross ridge may drop off in the reheat furnace, which requires that it then be removed, thus involving additional labor. Also, in the event the dross ridge remains adhered to the workpiece during reheating, it is laminated into the steel during rolling of he workpiece, resulting in an inferior product.

Heretofore, the dross ridges resulting from a torch cutting operation have been removed by a process involving inverting the workpiece and removing the dross ridges with scarfing torches. However, the required additional handling of the workpiece entails additional equipment and labor. Mechanical chippers or chisels have been employed for this purpose, but this also is a labor intensive process.

U.S. Pat. No. 2,301,923 suggests a process for dross removal which involves immediately cooling the slag as it emerges from the cut, and so that it rapidly solidifies and may be easily removed by a subsequent mechanical operation. This prior patent also states that it has been previously proposed to remove such slag formations from a hot workpiece by means of a shear, but it is indicated that this prior proposal was not entirely satisfactory since the shear was subject to slag accumulation due to its hot condition.

More recent U.S. Pat. No. 4,390,167 discloses the use of rotary metal cutters for removal of slag of the described type from an advancing workpiece, and this patent also discloses that the cutters may take the form of a plurality of tools arranged on a vertically movable mount. However, these cutters appear to be able to remove dross ridges only along one of the ends of the workpiece, and it is believed the cutters would be subject to jamming and would require substantial maintenance.

It is accordingly an object of the present invention to provide an apparatus and method for efficiently removing dross ridges formed on metal workpieces during a torch cutting operation or the like, and which avoids the limitations and disadvantages of the known prior art procedures.

It is also an object of the present invention to provide an apparatus and method for removing dross ridges without requiring the inverting or other complex manipulation of the workpiece.

It is a further object of the present invention to provide an apparatus and method for removing dross ridges and which may be installed in a conventional workpiece conveying line with a minimum of alteration thereto.

It is also an object of the present invention to provide an apparatus and method of the described type and which is characterized by its simplicity of construction and reliability of operation.

It is still another object of the present invention to provide an apparatus and method of the described type and which is adapted to remove dross ridges from a workpiece which is either hot or cold.

SUMMARY OF THE INVENTION

These and other objects and advantages of the present invention are achieved in the embodiments illustrated herein by the provision of an apparatus and method which includes a cutting blade having an outer surface and at least one longitudinally extending side, and with the one side defining a longitudinally extending cutting edge at the junction of the side and the outer surface. The cutting blade is mounted for pivotal movement about a longitudinal axis, and such that the blade is adapted to be mounted immediately adjacent the path of travel of a metal workpiece supported by a conveyor system, and with the longitudinal direction of the blade extending across the workpiece path of travel. Means are also provided for pivoting the cutting blade about the longitudinal axis, and so that the cutting edge may be held in contact with the adjacent surface of the workpiece moving along the path of travel. Thus the cutting edge is adapted to engage and remove a dross ridge formed on the adjacent workpiece surface when the workpiece is moved along the path of travel in a direction opposing the cutting edge.

In a preferred embodiment, the outer surface of the cutting blade is generally flat, and the blade includes a second longitudinally extending side, which is opposite and parallel to the first mentioned side. The second side and the outer surface also define a second longitudinally extending cutting edge at the junction of the second side and the outer surface. In this embodiment, the pivoting means is designed to selectively pivot the cutting blade about the longitudinal axis, and such that the blade may be pivoted to a neutral position wherein the outer surface is parallel to and spaced from the surface of a workpiece advancing along the path of travel, to a first tilted position wherein one of the cutting edges is adapted to engage the adjacent surface of the workpiece, and to a second oppositely tilted position wherein the other of the cutting edges is adapted to engage the surface of the adjacent workpiece. Thus each cutting edge is adapted to engage and remove a dross ridge formed on the workpiece surface when the workpiece is moved along the path of travel in a direction opposing such cutting edge. In addition, the means for advancing the metal workpiece along its path of travel is adapted to advance the workpiece in each direction, and so that dross ridges formed at the opposite ends of the workpiece may each be removed.

The apparatus of the present invention may be mounted in a metal workpiece conveying line, either on existing conveyor roll foundations or on a separate foundation, and with the horizontal or neutral position of the cutting blade being slightly below the pass line of the lower surface of the metal workpiece. In one embodiment of the method of the present invention, a workpiece having a dross ridge along its lower surface at each end is passed over the cutting blade, while the blade is in its neutral position. The blade is then tilted so that the cutting edge which faces the trailing end of the workpiece is raised into contact with the surface of the workpiece, and so that the raised cutting edge engages and shears the dross ridge adjacent the trailing end. The advance of the workpiece is then reversed, and the blade is pivoted to its opposite tilted position so that the other cutting edge is raised, and so that the dross ridge at the leading end of the workpiece is engaged and removed. In another embodiment, the method may be performed by terminating the advance of the workpiece after the leading end passes the cutting blade. The advance of the workpiece is then reversed, and the blade is tilted so that one of the cutting edges engages the surface of the workpiece and then engages and removes the dross ridge at the leading end of the workpiece. The advance of the workpiece is again reversed to its original direction, and the blade is tilted to its opposite position so that the opposite cutting edge engages and removes the dross ridge at the trailing end of the workpiece.

As will be apparent, the apparatus and method of the present invention are adapted to remove dross ridges from a hot metal workpiece, i.e., at its casting or rolling temperature, or at ambient temperature. Also, the dross ridge which is sheared from the surface of the workpiece tends to drop off, and there is no substantial buildup or accumulation thereof on the cutting blade, and the cutting blade remains relatively cool when operating on a hot workpiece since there is little surface contact between the blade and workpiece.

BRIEF DESCRIPTION OF THE DRAWINGS

Some of the objects and advantages of the present invention having been stated, others will appear as the description proceeds, when taken in conjunction with the accompanying drawings, in which.

DETAILED DESCRIPTION OF THE PREFERRED EMBODIMENTS

Figure 1:
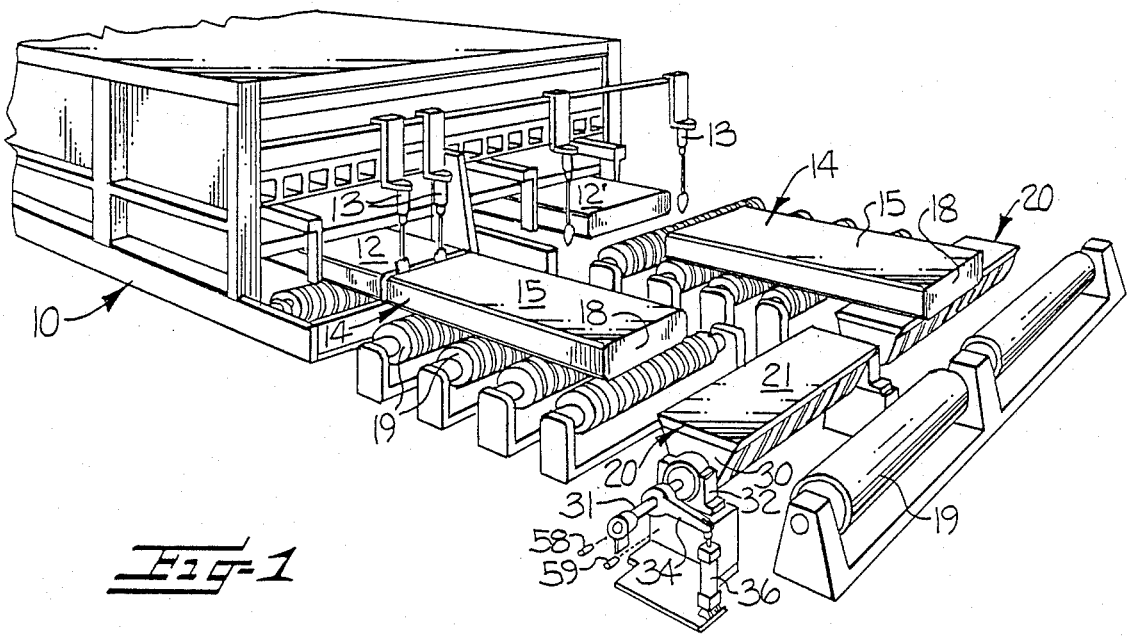
FIG. 1 is a perspective view of a continuous metal casting machine and the dross removal apparatus of the present invention.
Figure 5:
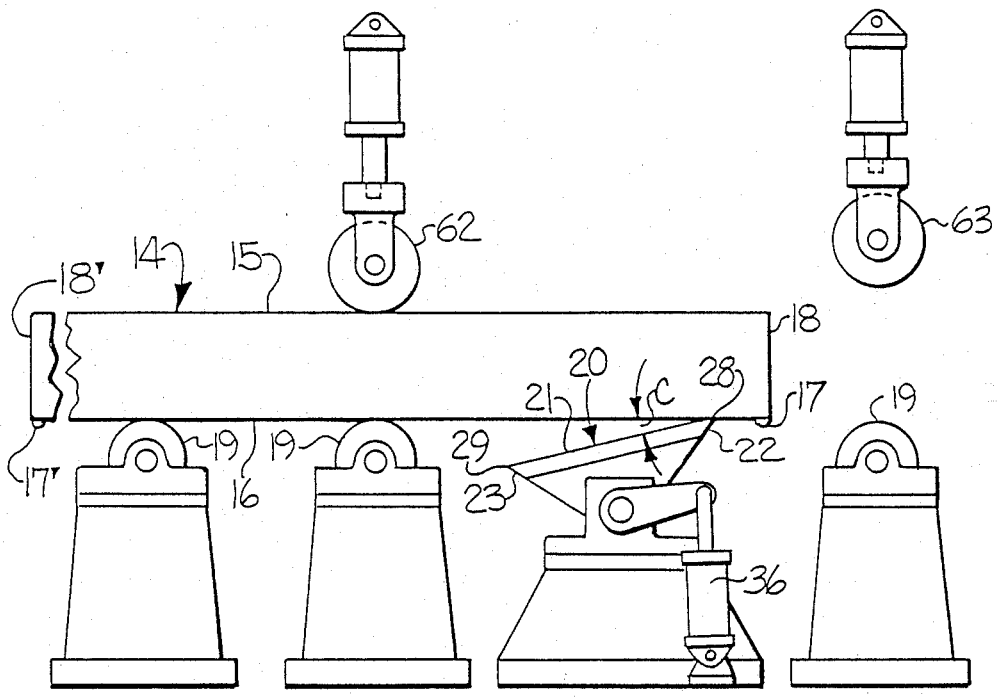
FIG. 5 is a side elevation view of a modified embodiment of the workpiece conveying line.

Referring more particularly to the drawings, FIG. 1 illustrates a conventional steel casting machine 10, of a type which is adapted to form two parallel continuous castings 12, 12'. An oxygen cutting torch 13 is mounted at the downstream end of each output line, to cut the castings into separate slabs, blooms, or billets, which are referred to herein as workpieces 14. As best seen in FIG. 5, each workpiece 14 has an upper surface 15, a lower surface 16, a leading end 18, and a trailing end 18'. Also, the workpiece includes a dross ridge 17, 17' formed on the lower surface adjacent the leading end 18 and the trailing end 18' of the workpiece, respectively.

The apparatus includes conveyor means in the form of a series of driven conveyor rolls 19, for advancing each workpiece along a horizontal path of travel, with the direction of the advance being such that the ends 18, 18' and the dross ridges 17, 17' are disposed perpendicular to the path of travel. However, this orientation may not be exactly perpendicular, since the torches 13 may be set to cut the workpieces at the angle, or the workpieces may shift on the rolls 19. In addition, the conveyor rolls 19 are adapted to selectively advance each workpiece in opposite directions along a horizontal path of travel, and in the manner further described below.

The apparatus of the present invention further comprises a cutting blade 20 mounted transversely across and below the path of travel of each workpiece 14. Each cutting blade 20 comprises a generally flat outer or top surface 21, which has a rectangular configuration in plan, and the blade includes opposite sides 22, 23 and opposite ends which define a longitudinal direction therebetween. The length of the blade is somewhat greater than the width of the workpiece being processed. The opposite sides 22, 23 each form an acute angle A with respect to the outer surface (note FIG. 5) with the angle A preferably being in the range from about 25° to 60°. The side 22 thus defines a longitudinally extending straight first cutting edge 28 at the junction of the side 22 and the outer surface 21, and the side 23 defines an opposite longitudinally extending straight cutting edge 29 at the junction of the side 23 and the outer surface 21.

Figure 2:
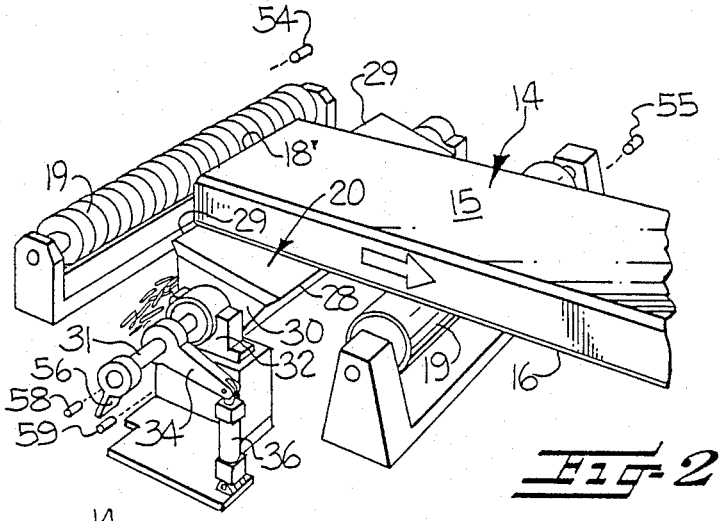
FIG. 2 is a fragmentary perspective view of the apparatus shown in FIG. 1 and illustrating one workpiece in an intermediate position wherein the dross ridge at its trailing end is removed.
Figure 3:
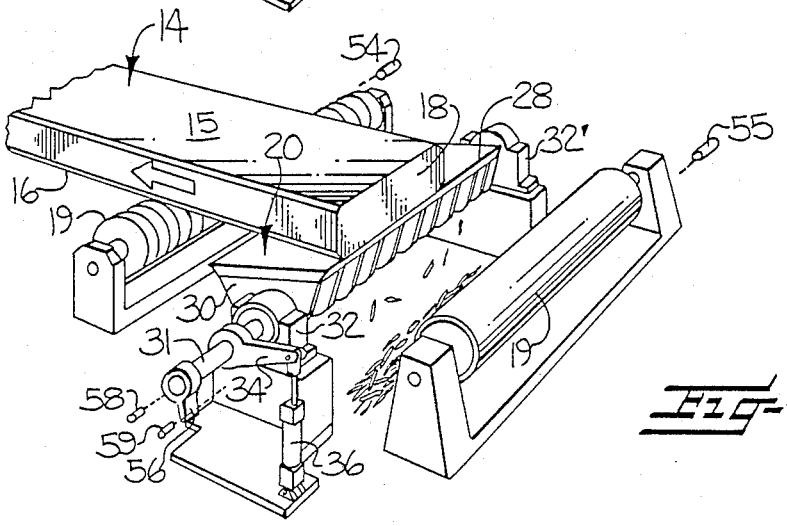
FIG. 3 is a view similar to FIG. 2 and illustrating the workpiece in a subsequent position and wherein the dross ridge at the leading end is removed.

The cutting blade 20 is mounted for pivotal movement about a longitudinal axis which is spaced from and parallel to each of the cutting edges 28 and 29. As best seen in FIG. 5, the pivotal axis is equally spaced from each of the parallel cutting edges 28, 29, and the separation between the parallel cutting edges is somewhat greater than the radial distance between the pivotal axis and each of the cutting edges. Also, the cutting blade is positioned immediately adjacent and below the workpiece path of travel, and such that the longitudinal pivotal axis of the cutting blade extends across the path of travel. This mounting means includes a support member 30 which underlies substantially the full area of the blade, and the support member includes stub shafts 31, 31' projecting from the opposite ends thereof and which are coaxially disposed along the longitudinal pivotal axis of the blade. As best seen in FIGS. 1–3, a pillow block bearing 32 journals the stub shaft 31, and a similar bearing 32' is provided for the shaft 31'. The stub shaft 31 extends through its support bearing and carries a lever arm 34, the arm 34 being held by a key (not shown) for rotation with the shaft 31. Alternatively, the key may be in the form of a shear pin which serves to prevent damage to the apparatus or workpiece in the event of an accidental collision with the apparatus. Connected to the outer end of the lever arm 34 is a movable piston rod end of a hydraulic cylinder 36. The base of the cylinder 36 is connected by a pin to a suitable foundation, with the foundation also mounting the bearing blocks 32, 32'.

The apparatus of the present invention further includes means for selectively pivoting the cutting blade about the longitudinal axis defined by the shafts 31, 31', and such that the blade may be selectively pivoted to a neutral position as shown in FIG. 1 and wherein the outer surface 21 of the cutting blade 20 is parallel to and spaced from the adjacent surface 16 of the workpiece 14 advancing along the path of travel. The blade 20 may also be pivoted to a first tilted position (FIG. 3) wherein the cutting edge 28 is adapted to engage the adjacent surface 16 of the workpiece, and to a second oppositely tilted position (FIG. 2) wherein the cutting edge 29 is adapted to engage the surface 16 of the workpiece. This pivoting means for the cutting blade is illustrated schematically in FIG. 8. More particularly, there is provided a hydraulic pump 40 driven by a motor 41 which provides the motive fluid through a pressure relief valve 42 to a solenoid actuated four-way valve 44 for the hydraulic cylinder 36. A holding valve 45 is provided between the four-way valve 44 and the cylinder 36, and a first switch 47 is provided for actuating the pump motor 41, and a second switch 48 energizes the solenoid valve control circuits. Preferably, indicator lights 49 and 50 are also controlled by the switches 47 and 48, respectively. The control of the solenoid valve 44 is by means of a switch 52, which in turn is operatively connected to the central control 53. Alternatively, the switches 47, 48, and 52 may be manually activated.

Figure 4:
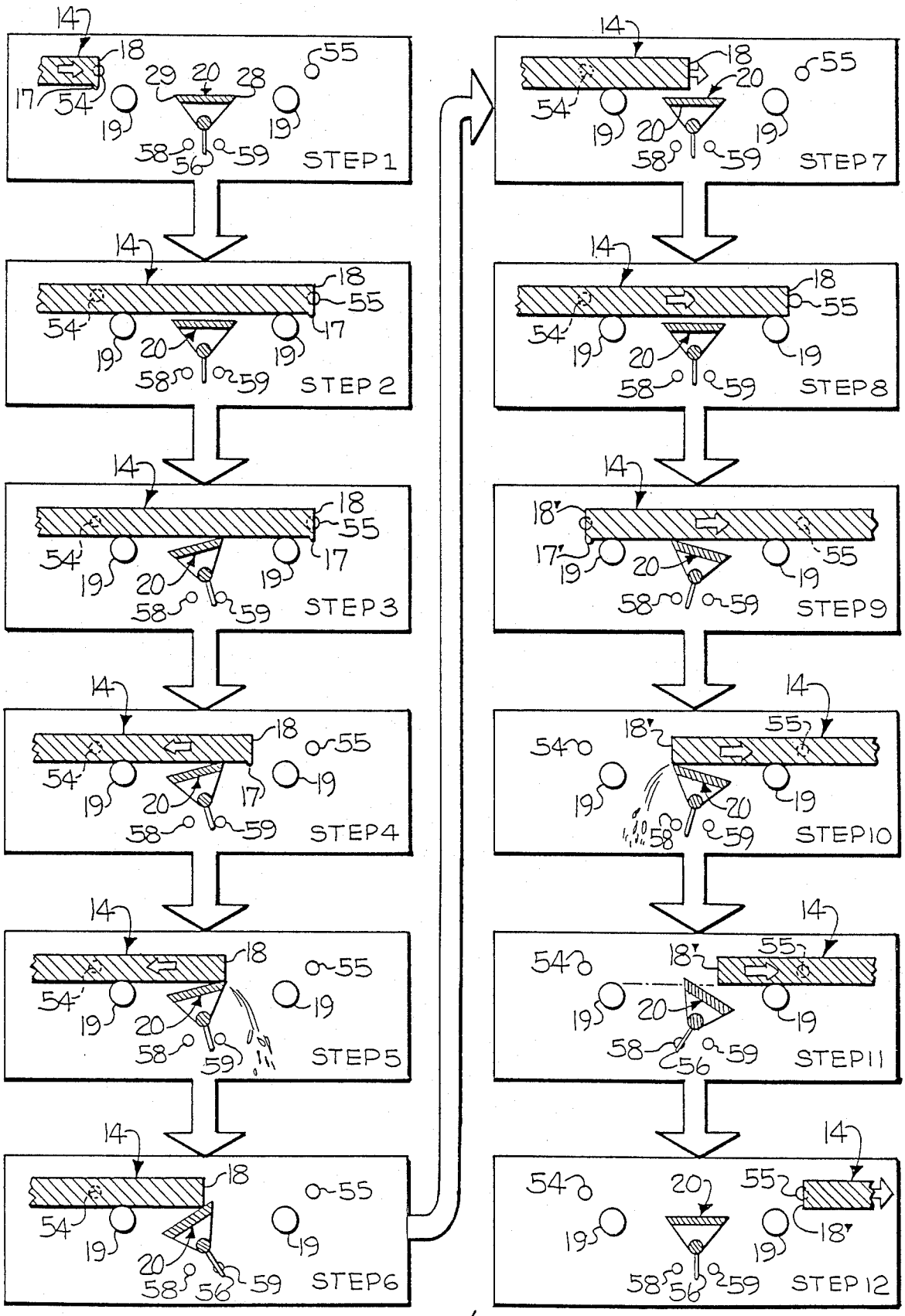
FIG. 4 is a schematic flow diagram illustrating another embodiment of the method of the present invention.
Figure 8:
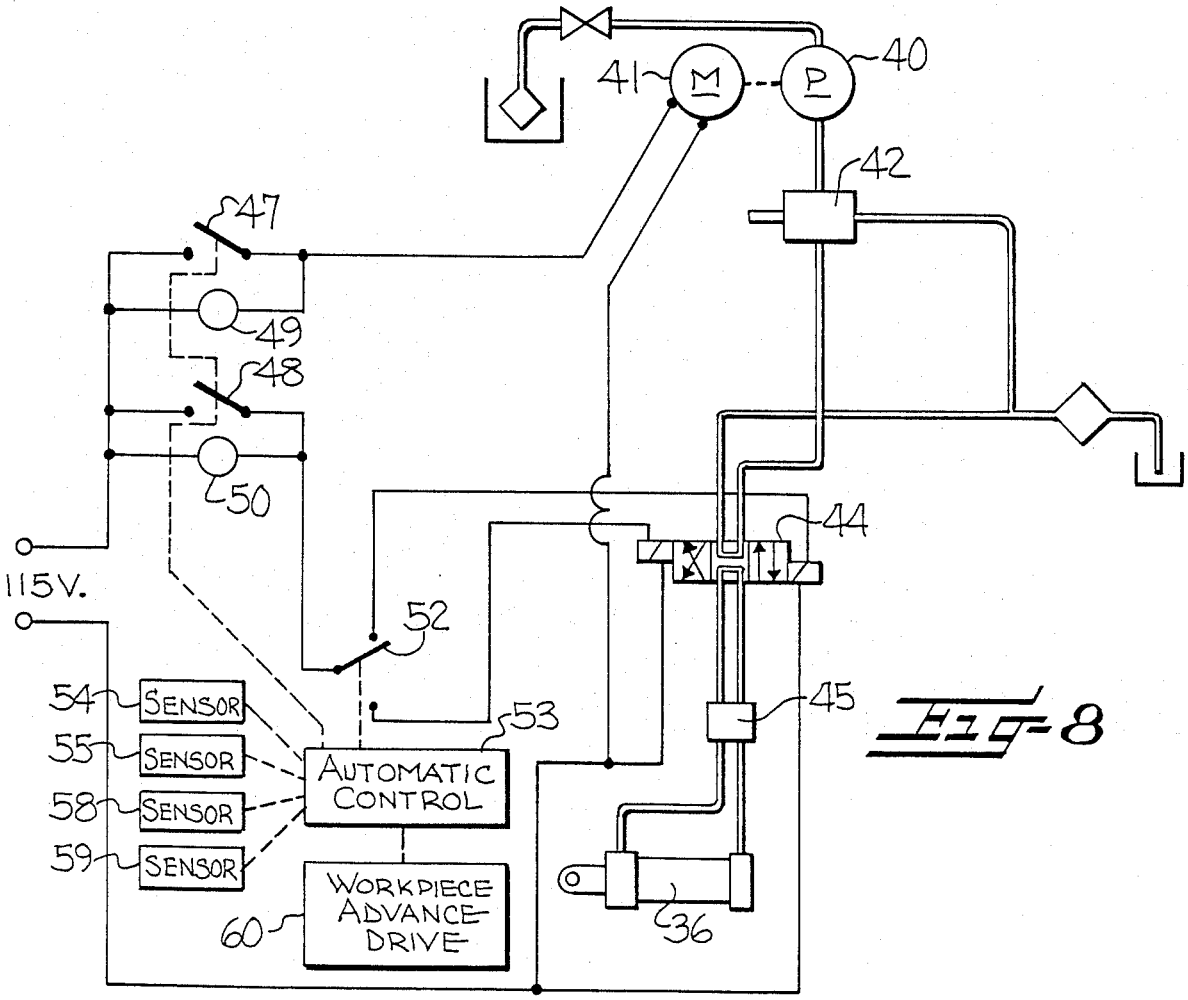
FIG. 8 is a schematic illustration of the control system for the apparatus of the present invention.

To provide for the automatic operation of the apparatus, the control means further includes a pair of workpiece position sensors located adjacent the workpiece path of travel, as indicated schematically at 54, 55 in FIGS. 2, 3 and 4. Also, there is provided a position indicator 56 mounted on the shaft 31 of the cutting blade, and two sensors 58, 59 are fixedly mounted adjacent the indicator 56 for monitoring the rotational position of the blade. These four sensors, 54, 55, 58 and 59 are operatively connected to the central control 53 of the apparatus, and the central control 53 is adapted to operate the workpiece advance drive 60 for the rolls 19, in response to signals from these four sensors and as schematically indicated in FIG. 8.

Figure 7:
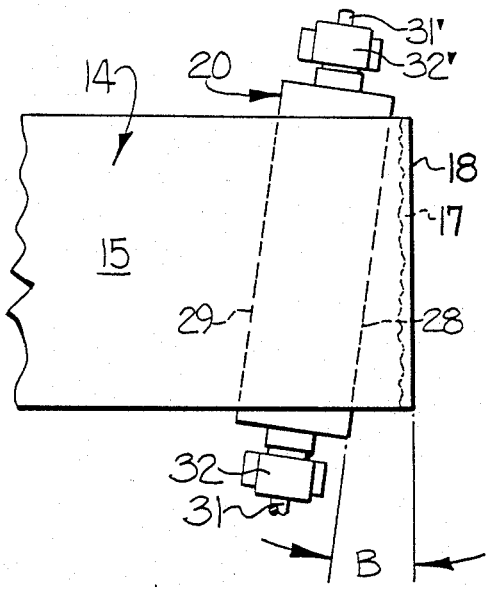
FIG. 7 is a top plan view of the apparatus and the workpiece.

The cutting blade 20 is mounted such that its longitudinal pivotal axis extends across the path of travel of the workpiece 14. While the blade can extend so that its longitudinal axis, and thus the cutting edges 28, 29 are exactly perpendicular to the path of travel, is it preferable for the cutting edges to be disposed at an angle of at least about one degree with respect to a line which is perpendicular to the workpiece path of travel, and thus also with respect to the ends 18, 18' and dross ridges 17, 17'. Preferably, the cutting edges 28, 29 are disposed at an angle of between about 1 to 15° with respect to a line which is perpendicular to the path of travel, note angle B in FIG. 7. In its neutral position, the surface 21 of the blade is slightly below a plane lying tangent to the upper surfaces of the conveyor rolls 19, and which corresponds to the location of the lower surface 16 of the workpiece, with a clearance of approximately one half to one inch being provided between the outer surface 21 of the blade and the conveyor plane. In addition, the cutting blade is sized and mounted such that the outer surface is at an angle C of at least about 1° and preferably about 10° with respect to the adjacent surface 16 of the workpiece in each of its two tilted positions, note FIG. 5. The tilt of the blade should not be so great as to cause the cutting edge to dig into or scrape the bottom surface of the work piece, nor should the tilt be so shallow that the blade tends to jump over the dross ridge rather than engage and shear it off.

FIGS. 1–3 illustrate one embodiment of the method of the present invention. In this embodiment, the workpiece 14 is advanced by the conveyor rolls 19, and after the leading end 18 of the workpiece passes the blade 20, the blade is tilted so that the cutting edge 29 which opposes the dross ridge 17' at the trailing end of the workpiece is tilted into contact with the lower surface of the workpiece. As the workpiece continues to advance, the cutting edge 29 engages and removes the dross ridge 17' at the trailing end. Thereafter, the workpiece advance is reversed, and the blade is returned to its neutral position. The blade is then tilted in the opposite direction so that the cutting edge 28 engages the bottom surface of the workpiece, and continued movement of the workpiece in the reverse direction causes the cutting edge 29 to engage and remove the dross ridge 17. The advance of the workpiece is then again stopped and reversed so that it advances in the forward direction, and the blade is tilted to its neutral position where it awaits the next workpiece.

FIG. 4 schematically illustrates a different embodiment of the method of the present invention. In this embodiment, the workpiece 14 is advanced in the forward direction until it spans the cutting blade (Steps 1 and 2). The sensor 55 is then activated, which acts through the central control 53 to stop the advance of the workpiece and to actuate the hydraulic cylinder 36 so as to pivot the blade and bring the forward cutting edge 28 into contact with the bottom surface of the workpiece (Step 3). The conveyor drive is then reversed (Step 4), moving the workpiece rearwardly, with the result that the cutting edge 28 engages and shears the dross ridge 17 at the forward end 18 of the workpiece (Step 5).

Following removal of the forward dross ridge 17 (Step 6), the conveyor drive is again stopped when the sensor 59 senses the blade has rotated past the plane of the lower surface 16 and thus past the forward end of the workpeice, and the blade is returned to its neutral position (Step 7), as determined by the sensors 58, 59. The workpiece is then again moved forwardly (Step 8), so as to position the workpiece across the blade. When the sensor 54 senses the trailing end 18', the blade is pivoted or tilted to bring the trailing cutting edge 29 into contact with the lower surface of the workpiece (Step 9), so that the cutting edge 29 engages the downstream dross ridge 17' to remove the same (Step 10).

The cutting blade is then returned to its neutral position (Steps 11 and 12), as determined by the sensors 58 and 59.

Additional blade monitoring sensors may be provided, in order to permit the more accurate sensing of five positions of the blade, namely (1) the neutral position, (2) a forwardly tilted position in contact with the surface 16, (3) a maximum forwardly tilted position, (4) a reversely tilted position in contact with the lower surface 16, and (5) a maximum reversely tilted position.

As will be apparent from the above, the dross removal apparatus of the present invention can be used to remove dross ridges from torch or flame cut workpieces having a wide range of sizes and shapes, and the cutting blade may be modified to accept curved or round workpieces as well. FIG. 5 illustrates a modification of the present invention and which includes pinch rolls 62 and 63, which are provided to support the workpiece relative to the blade 20, and which serve to prevent the lifting of the workpiece upon impact of a dross ridge with a cutting edge of the blade. Any conventional pinch roll construction may be used, and conventional drive means may be associated with the pinch rolls if desired to provide a positive advancing force to the workpiece as it moves across the blade and to prevent stalling of the workpiece when the blade contacts a dross ridge.

Figure 6:
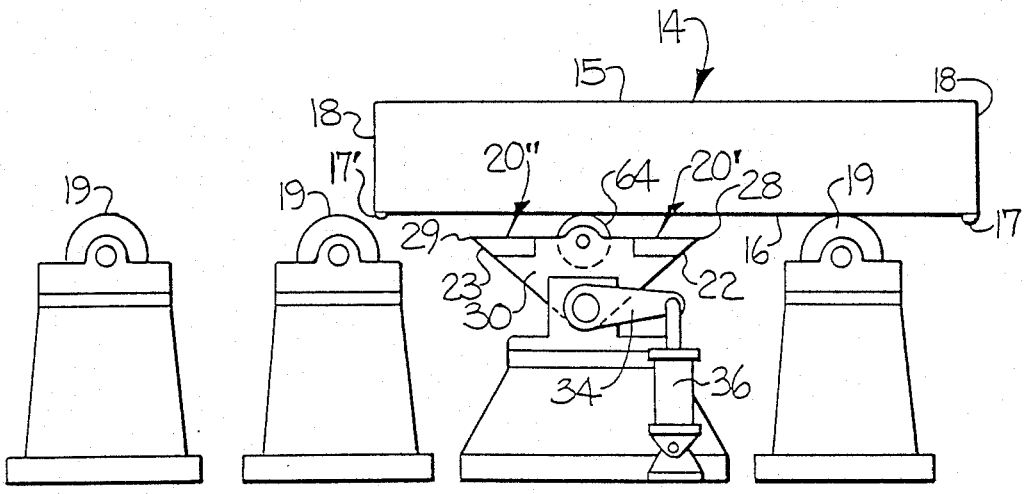
FIG. 6 is a side elevation view of another embodiment of the workpiece conveying line.
Figure 7A:
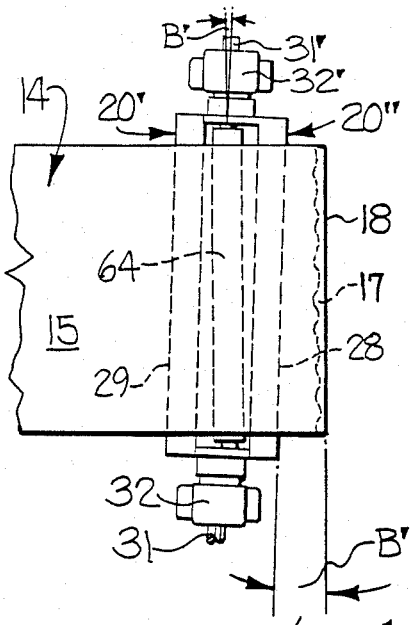
FIG. 7A is a view similar to FIG. 7 but illustrating an embodiment having an idler support roller.

Another modification of the present invention is illustrated in FIG. 6, wherein an idler support roller 64 is incorporated in the cutting blade to provide support for the workpiece. The idler support roller 64 is rotatably mounted to the support member 30, and it includes an outer surface portion which is coplanar with the upper surfaces of the rolls 19 when the blade 20 is pivoted to its neutral position as seen in FIG. 6. As illustrated, this modification is particularly suitable in cases where the workpiece may not be long enough to be adequately supported by the other support rolls 19 while it is advanced over the cutting blade 20. The axis of the idler support roller 64 is mounted so as to be perpendicular to the workpiece path of travel, and thus when the pivoted axis of the blade 20 is disposed at the angle B′ with respect to a line perpendicular to the path of travel as seen in FIG. 7A, the axis of the roller 64 is disposed at the same angle B′ with respect to the axis of the blade 20. FIG. 6 also illustrates a modification of the cutting blade, and wherein the cutting blade is defined by a separate elements 20′, 20″ which include the cutting edges 28, 29, and which are releasably attached to the support member 30 to facilitate replacement thereof.

It will be evident that in accordance with the present invention, a conventional "skid" or the like may be used as the supporting or conveying arrangement for the metal workpiece, and that conventional driven rolls, slab shifters, pusher rods or the like may be used to provide the advancing means for the workpiece. The dross removal apparatus of the present invention can also be used to remove dross ridges from the upper surface of a workpiece, by simply turning the workpiece over and mounting th cutting blade 20 in an inverted position above the workpiece. Also, the apparatus may remove dross ridges from cut sides of a workpiece, in addition to the cut ends, by having the cutting blade positioned squarely or obliquely with respect to the dross ridge along the cut side of the workpiece.

When known, automatic controls and sensing means are used with the dross removal apparatus of the invention, the cutting blade may be tilted from the horizontal or neutral position and to a tilted position where it is adapted to be engaged by the end of the advancing workpiece, to thereby serve as a means for locating the end of a new workpiece relative to the cutting blade. The cutting blade may then be tilted to the neutral position, permitting the dross ridge on the lower surface of the workpiece to pass over the cutting blade and so that the workpiece may overlie the cutting blade in accordance with the practice of the present invention as described above.

The following specific non-limiting example serves to further describe the present invention.

EXAMPLE

A series of dross removal tests were run on low carbon, steel plate workpieces in the following manner. In particular, a cutting blade was provided which was similar to that shown in FIGS. 1–3, and which was one inch thick, six inches wide, and 32 inches in length. The blade was mounted so that its top surface formed an angle C of 10° with the bottom surface of the workpieces when tilted, and the blade had a cutting edge angle A of about 38°. The workpieces were at ambient temperature, and were 10 inches thick, 22 inches wide, and 30 inches long, and the workpieces were cut across their width using a conventional oxy-acetylene cutting torch. A typical accumulation of dross adhered along the lower surface at each end of the workpiece after each cut, which was about one inch wide, 21 and ½ inches long, and 7/16 inches thick. The workpieces were supported on a roller conveyor table during each test, and they were pushed across the cutting blade by a hydraulic cylinder, mounted perpendicularly to the cut edge. The hydraulic cylinder had a bore of about 2 and ½ inches and pressure gauge mounted thereon.

In a first series of tests, the dross removal blade was set with the cutting edge of the blade parallel to the torch cut ends of the workpiece, and in a second series of tests the cutting edge was set at a five degree angle to the torch cut ends.

A summary of the force imparted to the cutting blade in order to remove dross ridges from the workpieces in the tests is reported in Table I below.

TABLE I

| Trial No. | Blade Parallel | Blade @ 5 Degree Angle |
|---|---|---|
| 1 | 8575 | 2572.5 |
| 2 | 8820 | 2327.5 |
| 3 | 6860 | 2450 |
| 4 | 5390 | 2450 |
| 5 | 7962.5 | 2572.5 |
| 6 | 8330 | 2450 |
| Average | 7656.25 lbs. | 2470.4 lbs. |

As shown in these results, the dross removal apparatus of the invention is able to remove dross from the torch cut ends of a metal workpiece with the blade parallel or angled with respect to the torch cut ends. However, it can also be seen from the results in Table I that the force required to remove a typical dross accumulation with the dross removal apparatus can be greatly reduced by angling the blade with respect to the torch cut ends.

In the drawings and specification, several preferred embodiments of the invention have been illustrated and described, and although specific terms are employed, they are used in a generic and descriptive sense only and not for purposes of limitation.

That which is claimed is:

1. An apparatus for removing a dross ridge along the edge of a metal workpiece of the type resulting from a torch cutting operation or the like, and comprising a cutting blade having an outer surface and a pair of longitudinally extending opposite sides, and with said sides each defining a longitudinally extending cutting edge at the junction of the side and said outer surface, and with said cutting edges being parallel to each other, means mounting said cutting blade for pivotal movement about a fixed longitudinal axis which is equally spaced from each of said cutting edges, and with the separation between said parallel cutting edges being at least substantially as great as the radial distance between said axis and each of said cutting edges, and such that the blade is adapted to be mounted immediately adjacent the path of travel of a metal workpiece supported by a conveyor system and with the longitudinal direction of said blade extending across the workpiece path of travel, and means for selectively pivoting said cutting blade about said longitudinal axis and so that either one of said cutting edges may be held in contact with the adjacent surface of a workpiece moving along said path of travel, and such that each of said cutting edges is adapted to engage and remove a dross ridge formed on the adjacent work-piece surface when the workpiece is moved along said path of travel with the dross ridge disposed substantially perpendicular to the path of travel and opposing said cutting edge.

2. Te apparatus as defined in claim 1 wherein said outer surface of said cutting blade is generally flat, and each of said cutting edges is straight.

3. The apparatus as defined in claim 1 further comprising idler support roller means rotatably mounted to said cutting blade at a location between said cutting edges for supporting the workpiece as it moves along said path of travel and across said cutting blade.

4. An apparatus for removing a dross ridge along the edge of a metal workpiece of the type resulting from a torch cutting operation or the like, and comprising conveyor means for supporting and selectively advancing a metal workpiece in opposite directions along a horizontal path of travel, a cutting blade comprising a generally flat outer surface, and a pair of opposite sides extending in a longitudinal direction along the length of said blade, and so that each side defines a longitudinally extending straight cutting edge at the junction of the side and said outer surface, means mounting said cutting blade for pivotal movement about a fixed longitudinal axis, and with said cutting blade positioned immediately adjacent said workpiece path of travel and such that the longitudinal pivotal axis of said cutting blade extends across said path of travel, and means for selectively pivoting said cutting blade about said longitudinal axis, and such that said blade may be selectively pivoted to a neutral position wherein said outer surface is parallel to and spaced from the surface of a workpiece advancing along said path of travel, to a first tilted position wherein one of said cutting edges is adapted to engage the adjacent surface of the workpiece, and to a second tilted position wherein the other of said cutting edges is adapted to engage the surface of the adjacent workpiece, and such that each cutting edge is adapted to engage and remove a dross ridge formed on the adjacent workpiece surface when the workpiece is moved along said path of travel with the dross ridge disposed substantially perpendicular to the path of travel and opposing such cutting edge.

5. The apparatus as defined in claim 4 wherein said cutting edges are parallel to each other and to said longitudinal axis, and wherein said cutting edges are equally spaced from said axis and are separated from each other a distance which is at least substantially as great as the radial distance between said axis and each of said cutting edges.

6. The apparatus as defined in claim 5 wherein said cutting edges extend at an angle of between about 1 to 15 degrees with respect to a line which is perpendicular to said workpiece path of travel.

7. The apparatus as defined in claim 5 wherein said cutting blade is mounted at a location spaced from said workpiece path of travel such that said outer surface is at an angle of at least 1° with respect to the adjacent surface of the workpiece in each of said first and second tilted positions.

8. The apparatus as defined in claim 5 wherein said conveyor means comprises means for sensing the position of a workpiece being advanced along said path of travel, and means responsive to said sensing means for reversing the direction of the advance of the workpiece.

9. The apparatus as defined in claim 8 wherein said means mounting said cutting blade includes a support member fixed to said blade, and a mounting shaft projecting from the opposite ends of said support member and coaxially along said longitudinal axis, and said means for pivoting said cutting blade includes hydraulic cylinder means operatively connected to said shaft and responsive to said sensing means for rotating said shaft in either direction about said longitudinal axis.

10. The apparatus as defined in claim 5 further comprising an idler support roller rotatably mounted to said support member and extending longitudinally along the length of said cutting blade and perpendicular to the path of travel, with aid idler support roller having an outer surface portion which is coplanar with said conveyor means when said cutting blade is in said neutral position and so as to assist in supporting the advancing workpiece.

11. The apparatus as defined in claim 5 wherein said cutting blade comprises two separate elements which include respective ones of said cutting edges and which are releasably attached to said support member to facilitate replacement thereof.

12. The apparatus as defined in claim 5 further comprising pinch roll means disposed on the side of said workpiece path of travel opposite said conveyor means for engaging the workpiece and preventing the lifting thereof from said conveyor means.

13. The apparatus as defined in claim 5 wherein said control means further includes additional sensing means for monitoring the angular position of said cutting blade.

14. A method of removing the dross ridges formed on the lower surface along each end of a flat metal workpiece during a torch cutting operation or the like, and which includes the use of a cutting blade having a generally flat outer surface and a pair of opposite sides extending in a longitudinal direction along the length of said blade, and with each side defining a longitudinally extending cutting edge at a junction of the side and said outer surface, and comprising the steps of (a) advancing the workpiece across said outer surface of said blade in an initial direction which is substantially transverse to the longitudinal direction of said blade, with said lower surface facing said cutting blade and with the dross ridges disposed substantially perpendicular to the direction of advance, and such that one of said dross ridges passes the blade without contact, (b) tilting the blade so that the one of said cutting edges which faces said one dross ridge engages the adjacent surface of the workpiece, and (c) advancing the workpiece in the opposite direction so that said one dross ridge moves in a direction opposing said one cutting edge of the tilted blade and such that said one cutting edge engages and removes said one dross ridge.

15. The method as defined in claim 14 comprising the further steps of (d) oppositely tilting the blade so that the other of said cutting edges engages the adjacent surface of the workpiece, and (e) advancing the workpiece in said initial direction and so that the other dross ridge moves in a direction opposing said other cutting edge of the oppositely tilted blade and said other cutting edge engages and removes said other dross ridge.

16. The method as defined in claim 14 wherein during each of said advancing steps, the cutting edges of said cutting blade are inclined at an angle of between about s1 to 15 degrees with respect to a line which is perpendicular to the direction of advance of said workpiece.

17. The method as defined in claim 14 wherein during each of said tilting steps, said outer surface of said blade is at an angle of at least about 1° with respect to the adjacent surface of the workpiece.

18. The method as defined in claim 15 wherein steps (d) and (e) are performed subsequent to steps (a), (b) and (c).

19. The method as defined in claim 15 wherein steps (d) and (e) are performed subsequent to step (a) and prior to steps (b) and (c).

* * * * *